US010987536B2

(12) United States Patent
Popenhagen

(10) Patent No.: US 10,987,536 B2
(45) Date of Patent: Apr. 27, 2021

(54) PLANKING EXERCISE BELT

(71) Applicant: Jaime L. Popenhagen, Genoa City, WI (US)

(72) Inventor: Jaime L. Popenhagen, Genoa City, WI (US)

( * ) Notice: Subject to any disclaimer, the term of this patent is extended or adjusted under 35 U.S.C. 154(b) by 0 days.

(21) Appl. No.: 16/290,103

(22) Filed: Mar. 1, 2019

(65) Prior Publication Data

US 2019/0282885 A1 Sep. 19, 2019

Related U.S. Application Data

(60) Provisional application No. 62/643,008, filed on Mar. 14, 2018.

(51) Int. Cl.

| | |
|---|---|
| ***A63B 71/06*** | (2006.01) |
| ***A63B 21/068*** | (2006.01) |
| ***A41F 9/00*** | (2006.01) |
| ***A63B 21/065*** | (2006.01) |
| ***A63B 21/00*** | (2006.01) |
| *A63B 21/06* | (2006.01) |
| *A63B 21/072* | (2006.01) |

(52) U.S. Cl.

CPC ..... *A63B 21/068* (2013.01); *A41F 9/002* (2013.01); *A63B 21/065* (2013.01); *A63B 21/4009* (2015.10); *A63B 21/0603* (2013.01); *A63B 21/072* (2013.01); *A63B 2071/0655* (2013.01)

(58) Field of Classification Search

CPC ... A41F 9/002; A63B 21/0442; A63B 21/072; A63B 21/00047; A63B 21/065; A63B 21/068; A63B 21/4009; A63B 23/0222; A63B 2071/0655; A63B 2071/0602; A63B 71/06; A63B 2208/0295

See application file for complete search history.

(56) References Cited

U.S. PATENT DOCUMENTS

| | | | | |
|---|---|---|---|---|
| 3,751,031 A * | 8/1973 | Yamauchi | A63B 21/065 482/105 |
| 4,984,786 A * | 1/1991 | Lemke | A63B 21/4001 482/105 |
| 5,588,940 A * | 12/1996 | Price | A63B 21/065 224/259 |
| 9,630,044 B2 * | 4/2017 | Nelson | A63B 21/065 |

(Continued)

OTHER PUBLICATIONS

Weight Plank hold with belt; website: https://www.youtube.com/watch?v=oLGdmuTx4Q4; retrieved: Jun. 4, 2020; posted: Nov. 9, 2015 (Year: 2015).*

*Primary Examiner* — Megan Anderson

(74) *Attorney, Agent, or Firm* — Dunlap Bennett & Ludwig, PLLC; Brendan E. Squire

(57) ABSTRACT

A planking exercise belt assists the user in performing a planking exercise regimen by alerting the user when a proper plank position is not maintained during performance of the regimen. The planking exercise belt includes a belt that is adjustably secured about the user's lower torso and waist. An adjustable strap interconnects the belt and a weight. A connector is provided on the belt to removably attach the strap to the belt. When a user droops or does not engage their core muscle groups, a tension in the strap is relieved to alert the user to the poor form in performing the exercise. When the user elevates their buttocks, the weight elevates from the ground to alert the user of this improper form.

18 Claims, 5 Drawing Sheets

(56) References Cited

U.S. PATENT DOCUMENTS

| | | | | |
|---|---|---|---|---|
| 9,931,532 | B2 * | 4/2018 | Castaneda | A63B 23/02 |
| 10,188,899 | B1 * | 1/2019 | Acuna, Jr. | A63B 21/4035 |
| 2007/0287609 | A1 * | 12/2007 | McBride | A63B 21/065<br>482/105 |
| 2014/0256519 | A1 | 9/2014 | Nelson | |
| 2014/0274593 | A1 * | 9/2014 | Kelly | A63B 21/4043<br>482/105 |
| 2020/0147439 | A1 * | 5/2020 | Acuna, Jr. | A63B 21/0414 |

* cited by examiner

PLANKING EXERCISE BELT

CROSS-REFERENCE TO RELATED APPLICATION

This application claims the benefit of priority of U.S. provisional application No. 62/643,008, filed Mar. 14, 2018, the contents of which are herein incorporated by reference.

BACKGROUND OF THE INVENTION

The present invention relates to exercise equipment, and more particularly to methods and equipment for performing planking exercises.

Planking is an exercise that targets the core muscles of the abdomen and lower back. The exercise is performed with the person supporting their body on their hands and feet, with their body in linear alignment so the body resembles a plank. While maintaining the plank position, the person engages their core muscle groups when performing the exercise.

Many individuals, particularly beginners, have problems with poor plank form, either from lack of knowledge of form, fatigue, or not engaging their core when in a hold position, or while in motion. Currently, there are no devices used in planking to aid in correcting form. This makes the person use/train their muscles correctly in plank hold/plank exercises. Likewise, for experienced and well conditioned persons, there are presently no apparatus that provide additional resistance for performing the exercise.

As can be seen, there is a need for an apparatus and method that allows a person to know that they are not maintaining proper plank form and to enhance the effectiveness of a planking exercise regimen.

SUMMARY OF THE INVENTION

In one aspect of the present invention an exercise apparatus is disclosed. The exercise apparatus includes a belt dimensioned to be worn about a lower torso of a user. A strap attached to the belt with a connector to attach belt to weight. The weight is selected from the group consisting of a plate, molded weight or a sandbag.

In some embodiments, an adjustment means is provided to fit the belt to the lower torso of the user. The attachment means may be a cinching coupler attached to a first terminal end of the belt, and the cinching coupler is adapted to threadingly receive a free end of the belt at a second terminal end of the belt or attachment may be permanently attached to belt on first terminal end with only one attachment needed to attach to the second terminal end. Attachment to weight may also be an adjustable nylon or similar material strap.

In some embodiments, the coupling is a D-link. The D-link may be attached to the belt via a woven web fabric material. A longitudinal length of the strap is adjustable. In other embodiments, the connector is a carabiner.

In other aspects of the invention, a method of performing a planking exercise is disclosed. The method includes the steps of fitting a belt about a lower torso of a user. The user then assumes a plank position. A strap interconnected between the belt and a weight supported below the user such that there is a tension in the strap when the user is in a proper plank position.

The method may also include attaching the strap to a connector attached to a front of the belt. An adjustment means is manipulated at a first terminal end and a second terminal end of the belt to adjust the belt to the user. Should strap be permanently attached to belt, a single slide adjustment to strap will adjust to the user.

The method also includes returning to the proper plank position when the tension is relieved in the strap and returning to the plank position when the weight is lifted.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide an improved method and apparatus for performing planking exercises. The present invention solves the problem of poor plank form, either from lack of knowledge of form, fatigue or not engaging the core when in a hold or in motion.

Figure 1:
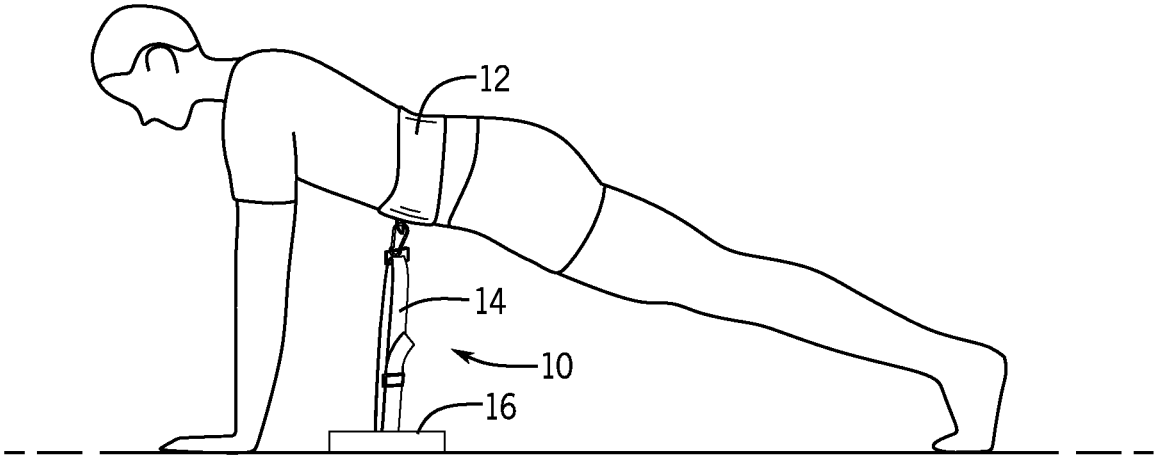
FIG. 1 is a side elevation view of the planking exercise belt being used properly.

As seen in reference to FIG. 1, a user is shown in an initial planking position with the planking belt 10 of the present invention. The planking belt 10 includes a belt 12 that is dimensioned to encircle the user's torso about the abdomen and lower back. A strap 14 extends from a coupling 22 on the belt 12. In some embodiments, the strap 14 may be attached to the belt 12 itself where permanently attached to belt 12, such as via stitching 13. The strap 14 is coupled to a weight 16 that rests on the floor. Each of the belt 12 and the strap 14 are adjustable in length.

The belt 12 and strap 14 are adjusted so as to tension the strap 14 while the proper plank position is being held or in motion. When the person does not engage their core muscles their body sags and the strap 14 slackens, indicating to the person that they have to pull back up (engage) to restore the tension in the strap 14. On the opposite end, if a person sticks their butt in the air during the plank, a weight 16 will rise off the ground reminding the user to restore the proper plank form. This happens while the plank is in a static hold or when the plank is in motion during exercises like plank jacks, mountain climbers, etc. The strap 14 and weight 16 are connected to a lightweight, comfortable belt 12 the person can wear throughout their entire workout.

There is no device to aid in properly performing a plank exercise. People are just told "don't stick your butt up" or "engage your core". Most people, particularly beginners, do not realize what "engage your core" even means and they do not realize that they have poor form at all. This invention adds an easy and effective solution to the problem of poor plank form.

Figure 2:
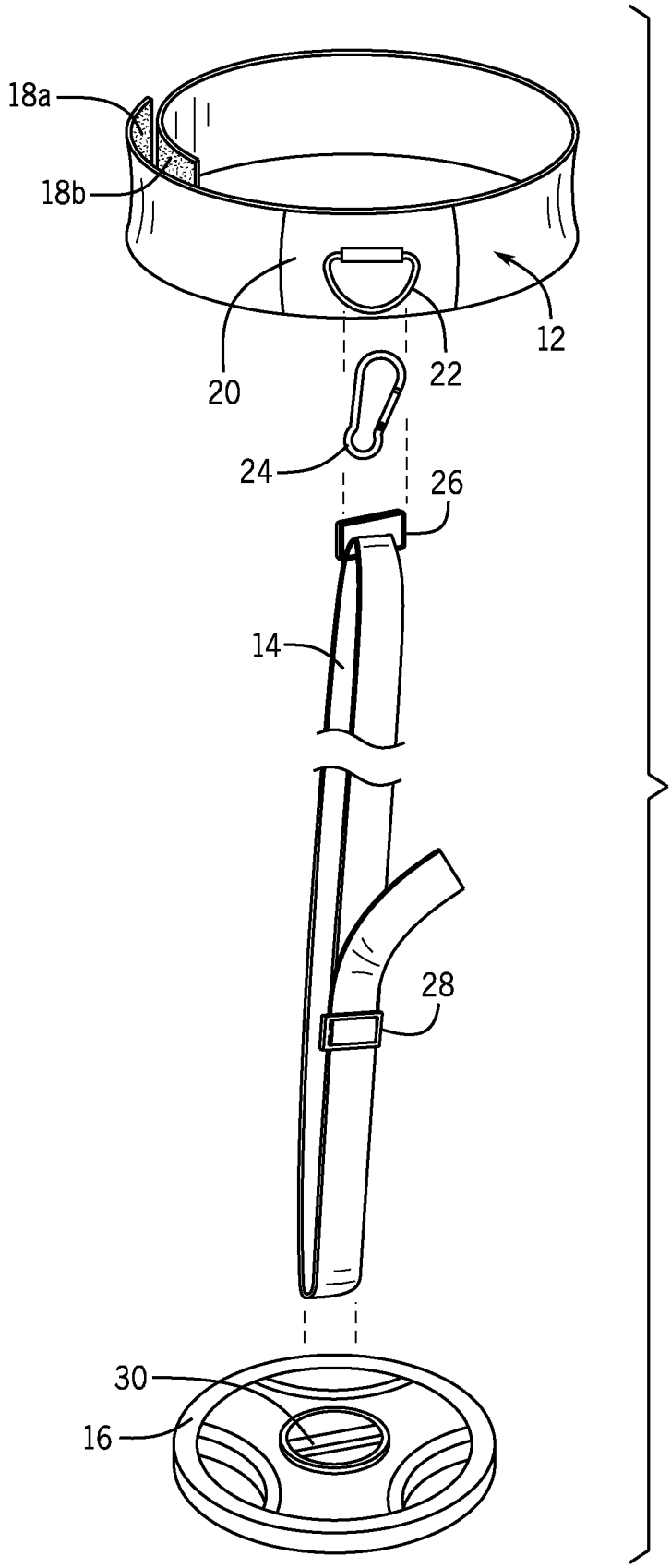
FIG. 2 is an exploded perspective view of the planking exercise belt.
Figure 3:
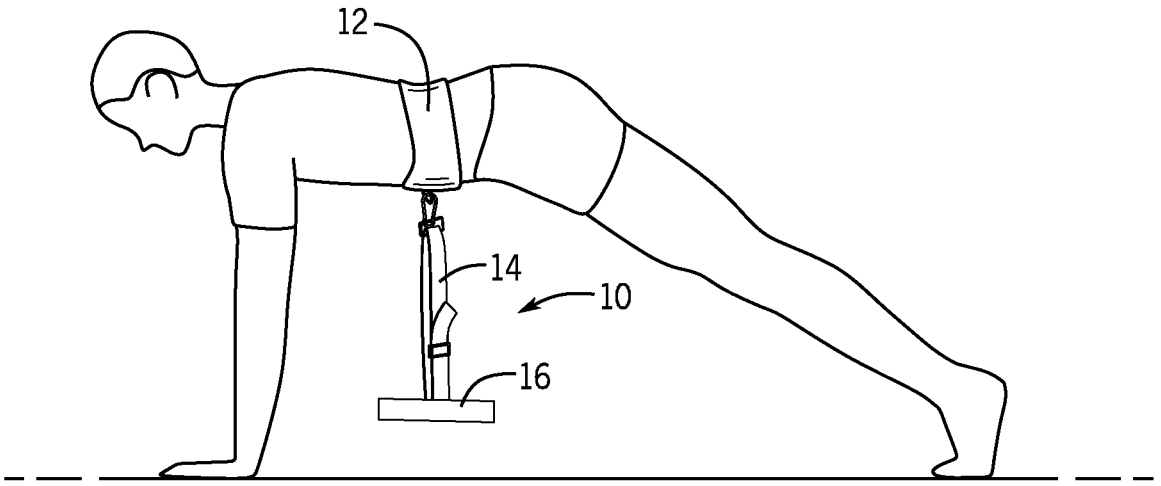
FIG. 3 is a side elevation view of the planking exercise belt being used improperly, indicated by the weight 16 being raised off a ground surface.
Figure 4:
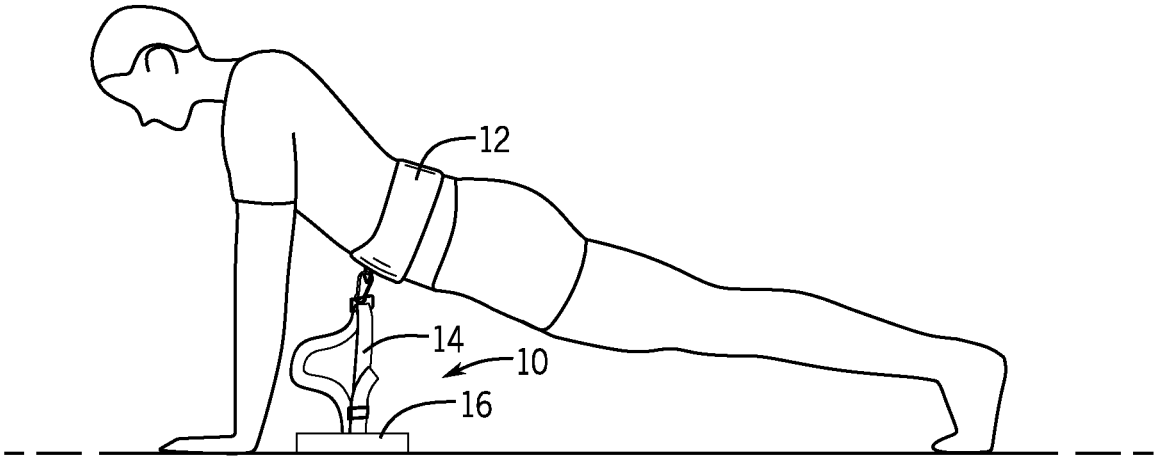
FIG. 4 is another side elevation of the planking exercise belt being used improperly, indicated by a loss of tension in the belt 14.
Figure 5:
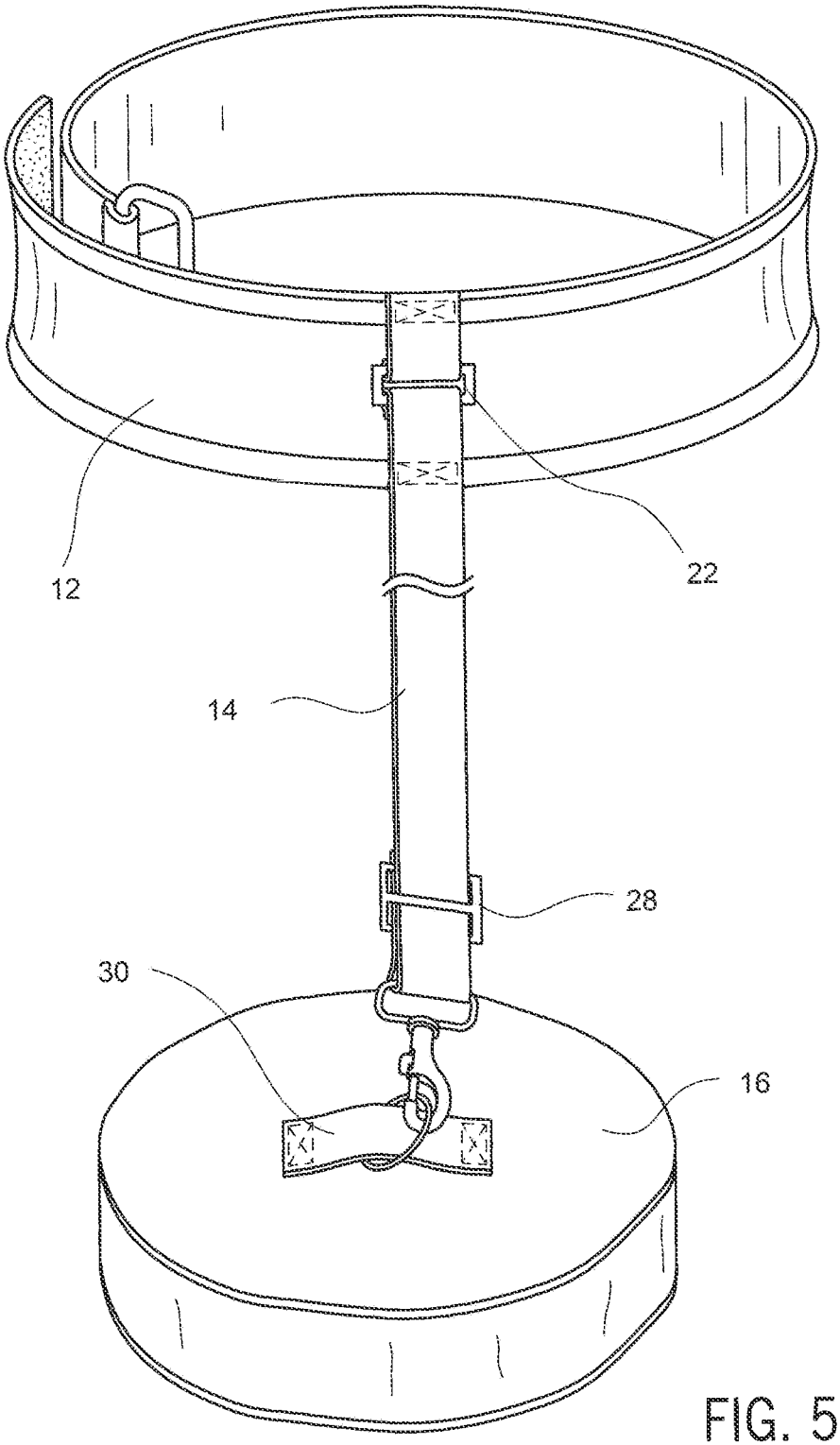
FIG. 5 is a front perspective view of a second embodiment of the planking exercise belt.
Figure 6:
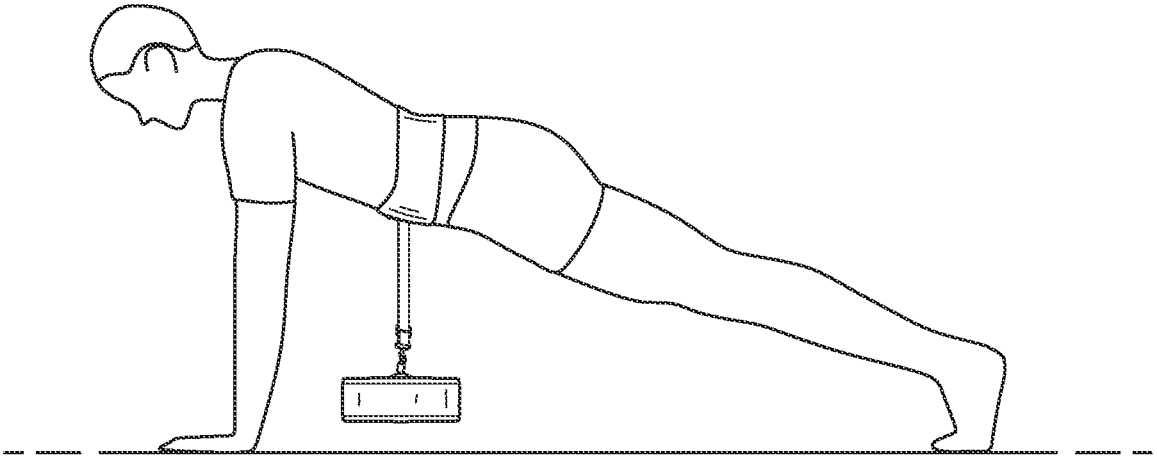
FIG. 6 is a side elevation view of the planking exercise belt being used improperly, indicated by the weight 16 being raised off a ground surface.

As seen in reference to FIG. 2, the planking belt 10 includes a coupling 22 attached at a forward point of the belt 12. The coupling 22 may include a D-ring that is attached with a loop of webbing that may be sewn to the belt. The planking belt 10 may also include a strap 14 that is permanently sown to the belt 12. In this instance, no coupling 22 is needed except at the opposite end of strap 14 to the weight 16. A reinforcement pad 20 may be disposed between the coupling 22 and the belt 12 to provide extra strength to the belt 12 at the coupling 22. The reinforcement pad 20 could be eliminated where the strap 14 is sewn directly into belt 12. A connector 24, such as a snap link, is interposed between the coupling 22 and a strap coupling 26 carried on the strap 14. The loop 26, may also be a D-ring, or the like. The connector 24 is attachable to at least one of the coupling 22 and the loop 26. The strap 14 may also be one solid piece that is sewn directly into belt 12 and utilize a single adjustment point.

The strap 14 may be formed with a loop at a first end and a second end of the strap 24. The strap coupling 26 is carried by the loop at the first end of the strap 14. The loop at the second end of the strap 14 may be threaded through an attachment point 30 of the weight 16. An adjuster 28 is provided to allow for adjustment in the length of the strap 14. The strap 14 may also be a continuous piece with one single hook or attachment point at end to connect to weight 16 attachment point 30.

The belt 12 includes an adjustment means 18*a*, 18*b* to fit the belt 12 to the user's lower torso. The adjustment means may include a cooperating fastener, such as a hook and pile material provided along terminal ends of the belt 12. The adjustment means may also include a buckle provided along a first terminal end of the belt and a plurality of cooperating apertures defined in a spaced apart relation along the second terminal end of the belt, a plurality of cooperating snap fasteners disposed in a spaced apart relation along each of the first and second terminal ends of the belt. The adjustment means may also include a cinching coupler attached to the first terminal end that is configured to receive the second terminal end in a threaded manner so that the belt 12 may be cinched about the lower torso.

In a non-limiting embodiment, the belt 12 may be formed of a 3" elastic material, belt. The belt 12 may also be a neoprene or similar material that is adjustable through a metal adjuster and Velcro®. The reinforcement 20 may include a thick vinyl material to secure the D-ring 22 and hook and pile fastener 18*a*, 18*b* to secure the free ends of the belt. The reinforcement may also be the strap 14 permanently sewn into the belt. 12. In this embodiment the hook and pile fastener 18*a*, 18*b* may be an industrial grade Velcro®. A carabiner hook 24 may be provided for easy attachment of the strap 14 to the D-ring. The strap 14 may be formed from a 1.5" polypro webbing strap. The strap 14 may also be made of nylon or similar material. The adjuster 28 may be a 1.5"×¼" heavy duty polyacetal plastic 1.5 inch×38 mm tri bar. The weight 16 may include a steel (approx.) 3 #weight. The attachment point 30 is carried inside an opening of the weight 16 a place for the strap to connect with a cut out so it doesn't slip. The weight 16 may also be a custom molded weight or a sand bag, both (approx.) 3 #.

Once a person has properly donned the belt 12 and attaches it to the weight 16 and the adjustable strap 14, they assume a proper plank position and adjust the strap 14 until there is tension on the strap 14. Once there is tension they will then hold the plank position or do their plank exercises. The planking belt 10 thereafter alerts the user if they lose proper form in any way (sagging/dropping/not engaging their core) or raise their butt in the air. The tension will either slacken when they droop so they won't feel the tension and they know to engage their core (aka raise up). If the weight 16 raises off the ground they will know their butt is in the air and are alerted to lower it to return to the proper planking position.

The belt 12 may also be worn to place the coupling 22 laterally, near the hips, so the apparatus 10 may utilized while performing a side plank. By sliding the belt 12 to the side and adjusting the strap 14 in that position, the user can then perform a side plank exercise regimen.

It should be understood, of course, that the foregoing relates to exemplary embodiments of the invention and that modifications may be made without departing from the spirit and scope of the invention as set forth in the following claims.

What is claimed is:

1. An exercise apparatus, comprising:

a belt configured and dimensioned to be worn about a lower torso of a user;

a coupling attached to a forward end of the belt and positioned at a medial centerline of the user when worn;

a strap having an adjustable length and a first end and a second end;

a connector to attach the strap to the coupling; and the second end adapted to attach to a weight, wherein the length of the strap is configured to be adjustable such that the strap is under a tension with the user in a planking position and the weight is in contact with a supporting surface.

2. The exercise apparatus of claim 1, wherein the coupling is a D-link.

3. The exercise apparatus of claim 2, wherein the D-link is attached to the belt via a woven web fabric material.

4. The exercise apparatus of claim 1, further comprising: means configured to adjust the belt to the lower torso of the user.

5. The exercise apparatus of claim 1, wherein an attachment means comprises a cinching coupler attached to a first terminal end of the belt, the cinching coupler is adapted to threadingly receiving a free end of the belt proximal to a second terminal end of the belt.

6. The exercise apparatus of claim 1, wherein the weight is selected from the group consisting of a plate; a custom mold, and a sandbag.

7. The exercise apparatus of claim 1, wherein a longitudinal length of the strap is adjustable via a buckle.

8. The exercise apparatus of claim 1, wherein the connector is a carabiner.

9. A method of performing a planking exercise, comprising:

fitting a belt about a lower torso of a user;

assuming a plank position; and adjusting a strap interconnected between the belt and a weight supported below the user such that there is a tension in the strap when the user is in a proper plank position and the weight is in contact with a floor surface beneath the user.

10. The method of claim 9, further comprising:

attaching the strap to a connector attached to a front of the belt.

11. The method of claim 9, wherein the fitting further comprises:

manipulating an adjustment means at a first terminal end and a second terminal end of the belt.

12. The method of claim 9, further comprising:

returning to the proper plank position when the tension is relieved in the strap.

13. The method of claim 9, further comprising:

returning to the plank position when the weight is lifted.

14. An exercise apparatus, comprising:

a belt dimensioned to be worn about a lower torso of a user; and a strap having a first end and a second end, wherein the first end is connected to the belt via a stitched connection configured to be positioned at medial centerline of the lower torso of the user when the belt is worn, and the second end is adapted to attach to a weight, the strap configured to have an adjustable length such that, when the user is in a proper planking position the length of the strap is under tension with the weight in contact with a support surface beneath the user.

15. The exercise apparatus of claim 14, wherein the weight is selected from the group consisting of a plate; a custom mold, and a sandbag.

16. The exercise apparatus of claim 15, further comprising:

an adjustment means to fit the belt to the lower torso of the user.

17. The exercise apparatus of claim 16, wherein the attachment means comprises a cinching coupler attached to a first terminal end of the belt, the cinching coupler is adapted to threadingly receiving a free end of the belt proximal to a second terminal end of the belt.

18. The exercise apparatus of claim 14, wherein when the user is in a bottom low planking position the strap is slack, and when the user is in a bottom high planking position, the weight is suspended from the strap above the support surface beneath the user.

* * * * *